US007311582B2

(12) United States Patent
Kroener et al.

(10) Patent No.: US 7,311,582 B2
(45) Date of Patent: Dec. 25, 2007

(54) CURRENT COLLECTING DEVICE FOR A TRACK GUIDED SPORT VEHICLE

(75) Inventors: Ralf Kroener, Bietigheim-Bissingen (DE); Uwe Reuter, Althengstett (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 282 days.

(21) Appl. No.: 11/076,254

(22) Filed: Mar. 10, 2005

(65) Prior Publication Data

US 2005/0208872 A1 Sep. 22, 2005

(30) Foreign Application Priority Data

Mar. 11, 2004 (DE) ..... 10 2004 011 933

(51) Int. Cl.
*A63H 18/12* (2006.01)

(52) U.S. Cl. ..... 446/446; 104/60

(58) Field of Classification Search ..... 446/446; 104/305, 60, 288, 295
See application file for complete search history.

(56) References Cited

U.S. PATENT DOCUMENTS 3,195,472 A * 7/1965 Rannalli ..... 104/60
3,350,953 A * 11/1967 Stewart ..... 74/411.5
4,479,650 A * 10/1984 Neuhierl ..... 463/63
4,643,102 A 2/1987 Arnau Manresa
6,038,685 A * 3/2000 Bissett et al. ..... 714/12

FOREIGN PATENT DOCUMENTS

| | | |
|---|---|---|
| DE | 1 603 514 | 1/1971 |
| DE | G 85 01 967.4 | 1/1985 |
| DE | 697 07 025 T2 | 1/1997 |
| EP | 0 786 277 B1 | 1/1997 |
| EP | 0 933 106 B1 | 2/1999 |

* cited by examiner

*Primary Examiner*—Kien Nguyen
(74) *Attorney, Agent, or Firm*—Crowell & Moring LLP

(57) ABSTRACT

A current collecting device for a toy vehicle for use on an electrified track. The toy vehicle is for operation on a road surface, and is driven by an electric motor installed in a chassis and having a chassis frame that carries the electric motor, whereby the current collecting device has strip-like contact elements which cooperate with current rails of the road surface. The contact elements which are in contact with the current rails of the road surface are carried by a replaceable unit which is connected to the current collecting device.

13 Claims, 4 Drawing Sheets

CURRENT COLLECTING DEVICE FOR A TRACK GUIDED SPORT VEHICLE

This application claims the priority of German patent document no. 10 2004 011 933.3, filed Mar. 11, 2004, the disclosure of which is expressly incorporated by reference herein.

BACKGROUND AND SUMMARY OF THE INVENTION

This invention relates to a current collecting device for a toy vehicle designed for operating on an electrified road surface.

A guidance device for a toy vehicle chassis for race cars on tracks, is known from European Patent 0 933 106 B1, in which a joint is provided in a front end area in front of the front axle, the joint acting between a console of a chassis and a carrier of the guide mechanism. A guide plate which cooperates with a guide groove of the racetrack is provided on the carrier of the guide mechanism and current collecting devices designed as contact brushes receiving power from the racetrack are provided.

German Patent DE 679 07 025 T2 describes an electrically driven toy vehicle having a chassis carried by wheels with an electric motor installed in the chassis. A guidance mechanism is connected to the chassis in the front end and protrudes with a flat journal into a guide groove of a track intended for the toy vehicle. The flat journal is designed to be pivotable about a vertical axis. Brushes mounted on the guide mechanism are in constant contact with electrically conducting rails of the track.

An object of the invention is to take measures on a current collecting device for a track toy vehicle such that the contact elements are advantageously integrated into the current collecting device of the toy vehicle and always correctly aligned with the current carrying rails of a road surface on which the toy vehicle is operated.

This object is achieved according to this invention by a current collecting device for a toy vehicle for use on a track, designed for operation on a road surface, driven by an electric motor installed in a chassis and having a chassis frame which carries the electric motor, whereby the current collecting device has strip-like contact elements which cooperate with current rails in the road surface, wherein the contact elements which are in contact with the current rails of the road surface are carried by a replaceable unit connected to the current collecting device.

The main advantages achieved with this invention may be regarded as the fact that the current collecting device of the toy vehicle comprises a replaceable unit which is easy to handle and with which the contact elements can be replaced without any effort (the contact elements are parts subject to wear because they are in grinding contact with the current rails of the road surface). The housing and the slide are formed by parts that are easy to manufacture, whereby the slide has a logical function. This also applies to the snap closure with the locking element, which not only reliably holds the slide in position but is also cut by pattern into the housing of the changing unit. The replaceable unit with the housing and the slide can be combined structurally in an advantageous manner with a guide mechanism of the toy vehicle, which can be accommodated together in a space-saving manner in the front end of the toy vehicle. Finally, the guidance mechanism which is pivotable about a vertical axis of rotation cooperates with a restoring device which attempts to move said guidance mechanism out of angular positions into a basic position so that there is no problem in positioning the toy vehicle, e.g., after leaving the road surface.

Other objects, advantages and novel features of the present invention will become apparent from the following detailed description of the invention when considered in conjunction with the accompanying drawings.

DETAILED DESCRIPTION

Figure 1:
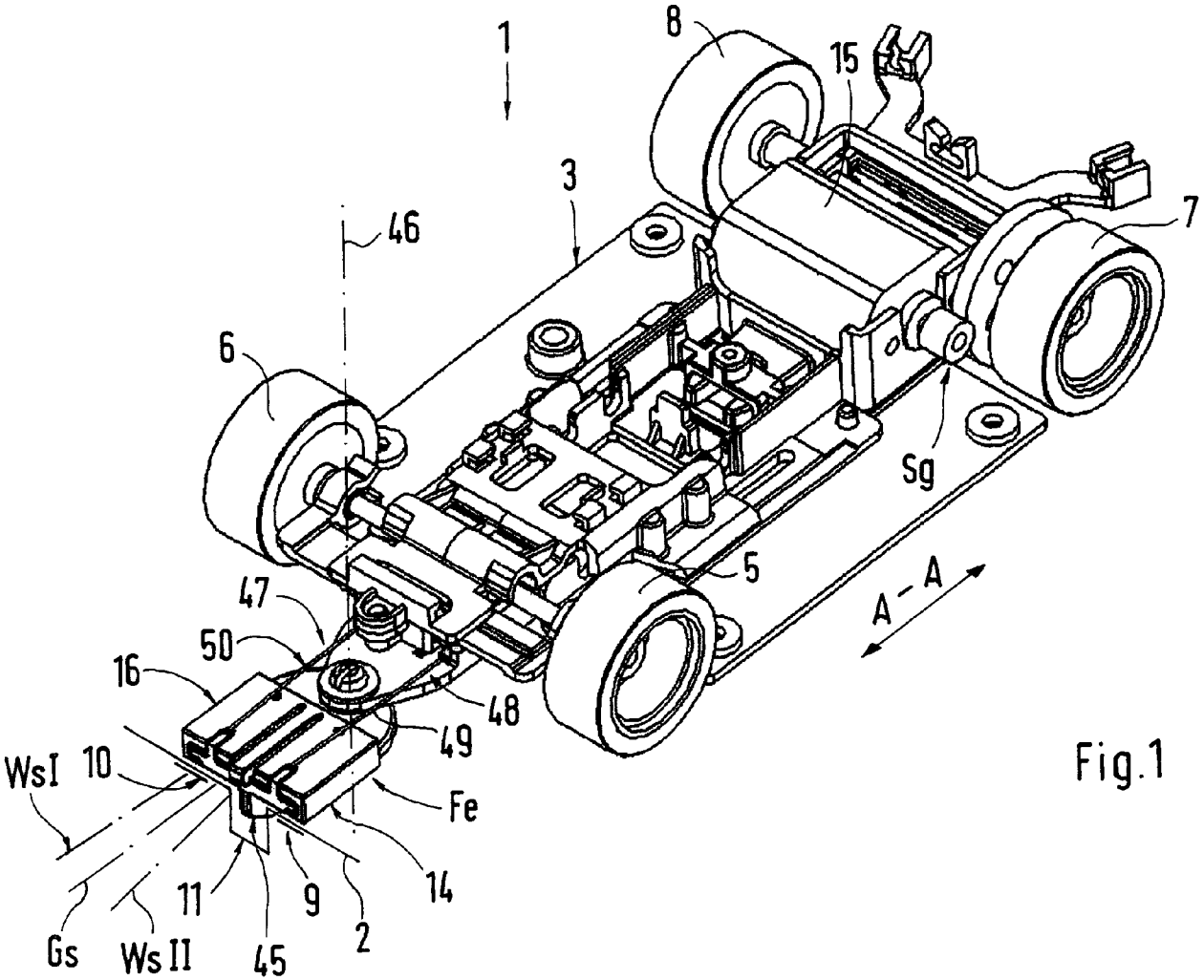
FIG. 1 shows an inclined view of a chassis for a toy vehicle having a current collecting device in accordance with an embodiment of the present invention.
Figure 2:
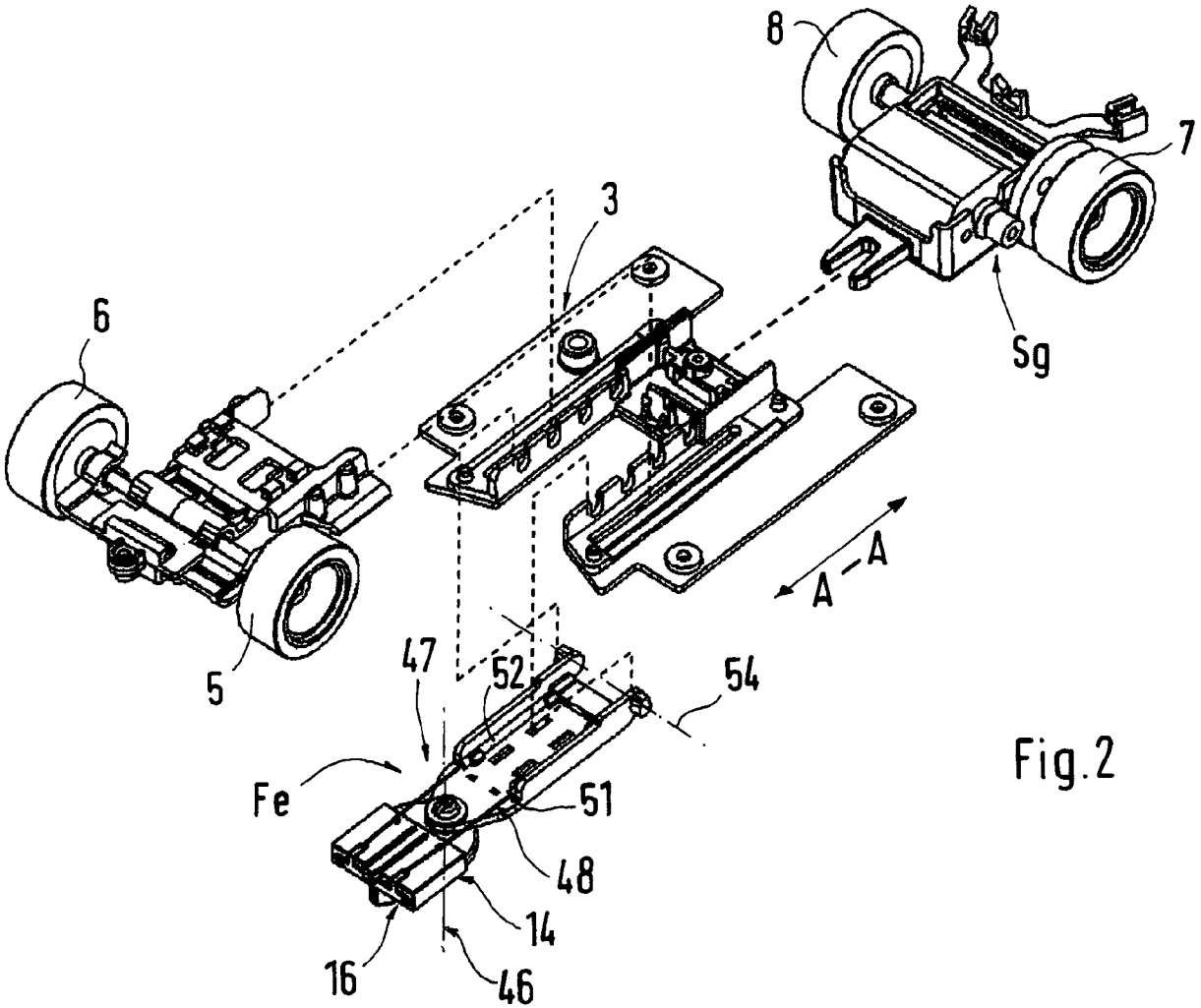
FIG. 2 shows an exploded drawing of the chassis of FIG. 1.
Figure 3:
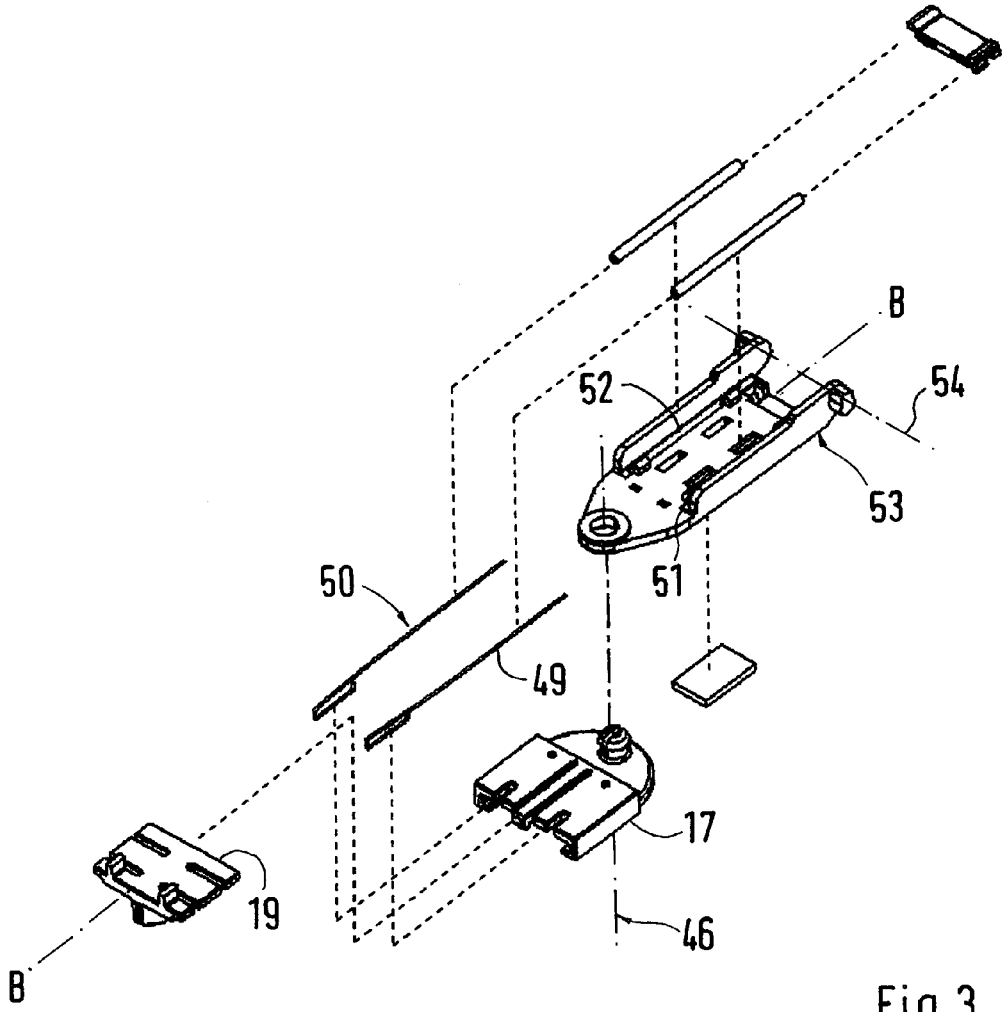
FIG. 3 shows an exploded drawing of the guide mechanism shown in FIG. 2.
Figure 4:
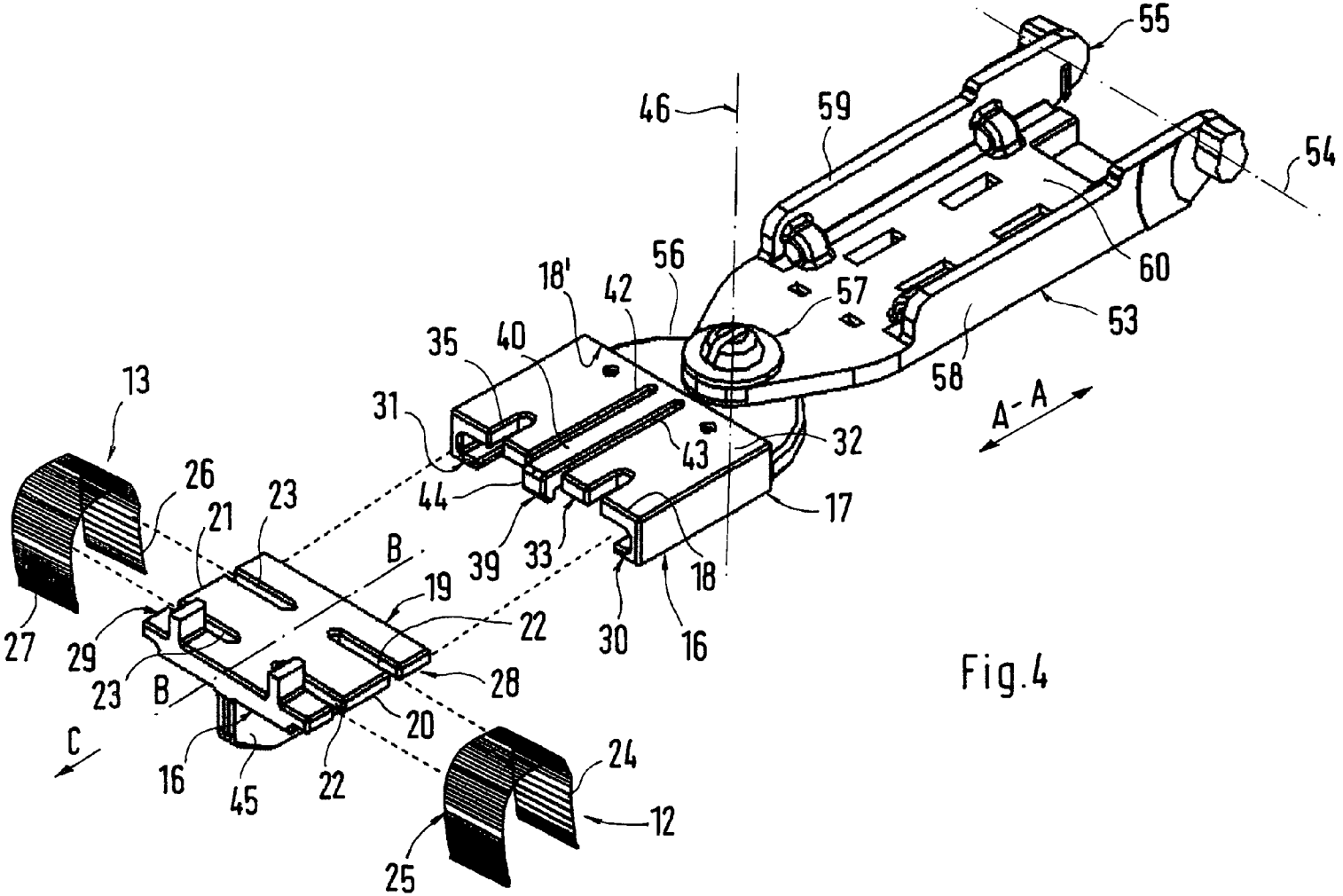
FIG. 4 shows a detail view of the guide mechanism shown in FIG. 3 on a larger scale.

A toy vehicle 1 is designed for operation on a road surface 2 and has a chassis 3 which is carried by front wheels 5 and 6 and rear wheels 7 and 8. The road surface 2 is provided with current rails 9 and 10 and a guide groove 11, which cooperates with a guide mechanism Fe arranged in the front end of the toy vehicle 1. An electric motor 15, which is installed in the chassis 3 across the longitudinal direction A-A of the vehicle, is supplied with power via the current rails 9 and 10 and a current collecting device 14, which has strip-like contact elements 12 and 13 (FIG. 4), and drives the rear wheels 7 and 8 with the intermediate connection of a spur-gear unit Sg, for example.

The contact elements 12 and 13 which are in grinding contact with the current rails 9 and 10 are inserted into a replaceable unit 16 and may be replaced easily because they are parts subject to wear. The replaceable unit 16 (FIG. 4) is connected to the current collecting device 14 and comprises an approximately rectangular housing 17 (the longer sides 18 and 18' run across the longitudinal direction A-A of the vehicle) with a drawer-like slide 19. The contact elements 12 and 13 are secured between the housing 16 and the slide 19. The slide 19 and the housing 17 are designed to be symmetrical with a central longitudinal plane B-B of the toy vehicle 1, whereby the slide 19 has supporting journals 20 and 21 and receptacle slots 22 and 23 on both sides of the central longitudinal plane B-B. The relatively flexible contact elements 12 and 13 have a U-shaped design, are passed around the supporting journals 20 and 21 and penetrate with the contact lugs 24, 25 and 26, 27 the receptacle slots 22 and 23. The contact lugs 24 and 25 rest on the current rails 9 and 10 of the road surface 2. The supporting journal 20 and 21 of the slide 19 are designed in the form of plates and are gripped on longitudinal sides 28 and 29 by U-shaped receptacles 30 and 31 of a horizontal housing wall 32 of the housing 16. On both sides of the central longitudinal plane B-B, securing slots 34 and 35 are provided on a first front side 33 of the housing wall 32, locking journals 37 and 38 being mounted on a second front side 36 of the slide 19 and pointing in the direction of the housing wall 32 protruding into the securing slots.

A snap closure 39 having an elastic blocking element 40 on the housing wall 32 which secures the slide 19 in the direction of extraction C is operative between the slide 19 and the housing 17 made of plastic. The blocking element 40 is formed by notches 41 and 42 running parallel to the central longitudinal plane B-B, and a locking hook 44 supported on the slide 19 is provided on a free end 43 of the locking element 40.

The replaceable unit 16 for the contact elements 12 and 13 is connected to the guide mechanism Fe of the toy vehicle 1 which engages along an upright guide plate 45 in the guide groove 11 of the road surface 2. The guide plate 45 is arranged on the slide 19 in such a way that the slide 19 has a T shape.

The guide mechanism Fe is pivotable about a vertical axis 46 of rotation and cooperates with a resilient restoring device 47 which attempts to move the guide mechanism Fe out of angular positions WsI and WsII into a basic position Gs. To do so, the restoring device 47 comprises a spring wire device 48 which works between the housing 16 and the 2 chassis [sic; the chassis 3]. The spring wire device 48 has two spring wires 49 and 50 running at the same distance from the central longitudinal plane B-B, these spring wires being connected at one end to the housing 17 and being held at the other end in tubular bodies 51 and 52 of the chassis 2 [sic; 3] and/or a pivot arm 53 of the chassis 2 [sic; 3]. The pivot arm 53 is mounted to rotate about a horizontal axis 54 of rotation on the chassis 2 [sic; 3] and is part of the guide mechanism Fe, whereby the pivot arm 53 has a rear arm element 55 and a front arm element 56 which are held in position by a screw connection 57 that includes the vertical axis 46 of rotation. The rear arm element 55 is U-shaped with leg walls 58 and 59 and a web wall 60. On the inside 61 of the arm element 55 the tubular bodies 51 and 52 are laid at an angle between the leg walls 58 and 59. Finally, the spring wires 49 and 50 and the tubular bodies 51 and 52 are made of metal and are designed as current transfer elements between the contact elements 12 and 13 and the electric motor 15.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Current collecting device for a toy vehicle for use on a track, designed for operation on a road surface, driven by an electric motor installed in a chassis and having a chassis frame which carries the electric motor, whereby the current collecting device has strip-like contact elements which cooperate with current rails in the road surface, wherein the contact elements which are in contact with the current rails of the road surface are carried by a replaceable unit connected to the current collecting device, and the replaceable unit for the contact elements has a housing with a drawer-like slide, said contact elements comprising the contact lugs being secured between the slide and the housing.

2. Current collecting device as claimed in claim 1, wherein the slide comprises supporting journals and receptacle slots, and the contact elements are the strip-like U-shaped contact elements which are passed around the supporting journals and penetrate with contact lugs into the receptacle slots.

3. Current collecting device as claimed in claim 2, wherein the supporting journals have a plate-like shape and are gripped on their longitudinal sides by U-shaped receptacles of a horizontal housing wall of the housing.

4. Current collecting device as claimed in claim 3, wherein the housing wall has on a first front side locking slots into which locking journals mounted on a front side of the slide protrude.

5. Current collecting device as claimed in claim 4, wherein a snap closure is operative between the slide and the housing.

6. Current collecting device as claimed in claim 5, wherein the snap closure has a resilient locking element on the housing wall securing the slide in an extraction direction.

7. Current collecting device as claimed in claim 6, wherein the locking element is gripped by notches spaced a distance apart in the housing wall, with a locking hook being provided on a free end of the locking element.

8. Current collecting device as claimed in claim 1, wherein the replaceable unit for the contact elements of the current collecting device is structurally combined with a guide mechanism of the toy vehicle, said guide mechanism engaging along an upright guide plate in a guide groove of the road surface.

9. Current collecting device as claimed in claim 8, wherein the guide plate of the guide mechanism is mounted on the slide, whereby the guide plate and the slide have a T shape.

10. Current collecting device as claimed in claim 9, wherein the guide mechanism is pivotable about a vertical axis of rotation and cooperates with a resilient restoring device which attempts to move the guide mechanism out of angular positions relative to the toy vehicle's longitudinal axis into a basic position.

11. Current collecting device as claimed in claim 10, wherein the restoring mechanism comprises a spring wire device which operates between the housing and a pivot arm of the chassis.

12. Current collecting device as claimed in claim 11, wherein the spring wire device comprises two spring wires running at the same distance from a central longitudinal plane of the toy vehicle, these spring wires being held at one end on the housing and at the other end in tubular bodies of the pivot arm.

13. Current collecting device as claimed in claim 12, wherein the spring wires and the tubular bodies are connected as current transfer elements to the contact elements.

* * * * *